US006279430B1

(12) United States Patent
Hsieh

(10) Patent No.: US 6,279,430 B1
(45) Date of Patent: Aug. 28, 2001

(54) F-TYPE SOCKET WRENCH

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/559,597

(22) Filed: Apr. 28, 2000

(51) Int. Cl.[7] ..... B25B 23/16
(52) U.S. Cl. ..... 81/177.7; 81/177.1
(58) Field of Search ..... 87/177.1, 177.7, 87/177.75, 177.8, 60

(56) References Cited

U.S. PATENT DOCUMENTS 2,028,561 * 1/1936 Pilger ..... 81/177.7 X
2,503,373 * 4/1950 Browning et al. ..... 81/177.7
2,800,821 * 7/1957 Fruscella ..... 81/60
2,951,405 * 9/1960 Engquist ..... 81/177.8 X
4,662,251 * 5/1987 Kohal ..... 81/60 X
5,904,077 * 5/1999 Wright et al. ..... 81/177.7 X

* cited by examiner

*Primary Examiner*—James G. Smith
(74) *Attorney, Agent, or Firm*—Pro-Techtor International Services

(57) ABSTRACT

A F-type socket wrench including a handle, a coupling block mounted in an opening of the handle, a steel ball stopped between a transverse back groove of the coupling block and a spring inside the handle, a tightening up screw threaded into an axial screw hole at the front end of the handle and having a rounded front end stopped against a transverse front groove of the coupling block, the coupling block having a square coupling rod for turning a wrench socket, the square coupling rod having a diagonal line between its two angles disposed in parallel to the longitudinal center line of the handle.

1 Claim, 5 Drawing Sheets

F-TYPE SOCKET WRENCH

BACKGROUND AND SUMMARY OF THE INVENTION

The present invention relates to a F-type socket wrench which needs less storage space, and can be operated in a narrow space.

FIG. 1 shows a F-type socket wrench according to the prior art. This structure of F-type socket wrench comprises a handle 11 having a forked front end, and a coupling block 12 pivoted to the forked front end of the handle 11 and having a square coupling rod 121 for turning a wrench socket. FIG. 2 shows another structure of F-type socket wrench according to the prior art. This structure of F-type socket wrench comprises a handle 21 having a rounded front end, and a coupling block 22 having a forked rear end pivoted to the rounded front end of the handle 21 and a front end terminating in a square coupling rod 221 for turning a wrench socket. The aforesaid two F-type socket wrenches have drawbacks. Because the size of connecting area between the handle 11; 21 and the coupling block 12; 22 is greater than the diameter of the square coupling rod 121; 221, these F-type socket wrenches require much storage space, and can not be used in a narrow space.

According to one embodiment of the present invention, the coupling block has two transverse grooves at front and back side thereof, a tightening up screw and a spring-supported steel ball and forced into engagement with the transverse grooves of the coupling block to hold the coupling block in an opening of the handle, permitting the coupling block to be turned within a limited angle. According to another embodiment of the present invention, the coupling block is coupled to the handle by a ball and socket joint.

DETAILED DESCRIPTION OF THE PREFERRED EMBODIMENT

Figure 1:
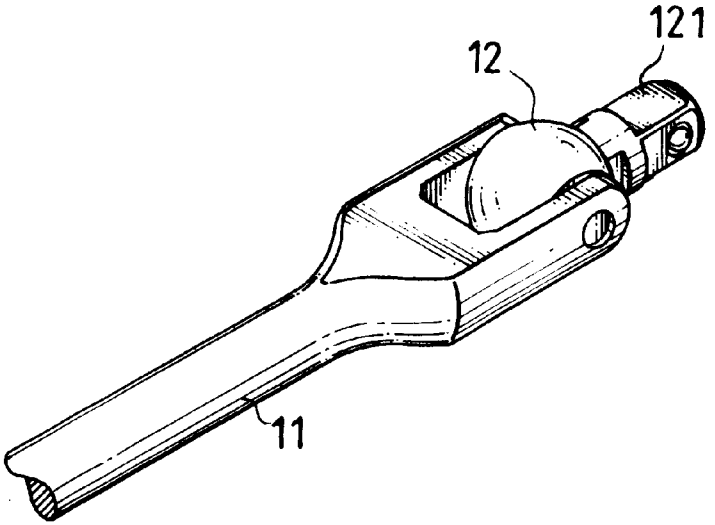
Fig. 1 PRIOR ART
FIG. 1 shows a F-type socket wrench according to the prior art.
Figure 2:
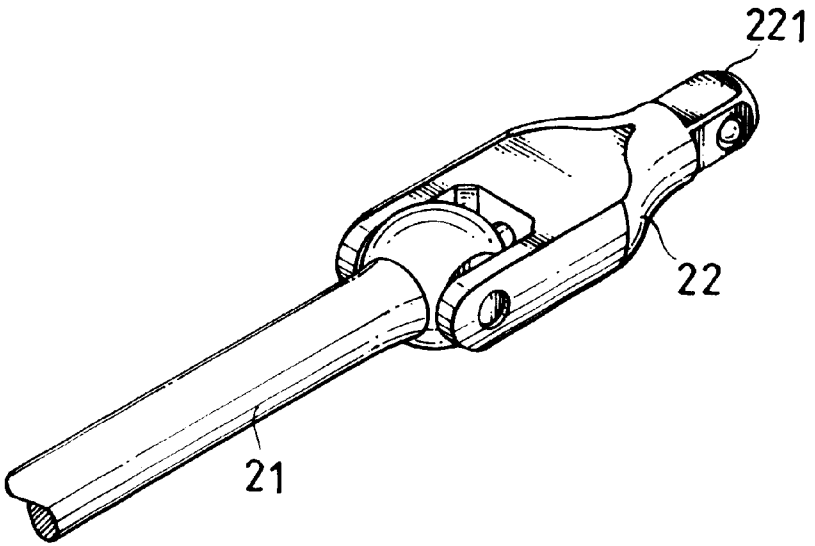
Fig. 2 PRIOR ART
FIG. 2 shows another structure of F-type socket wrench according to the prior art.
Figure 3:
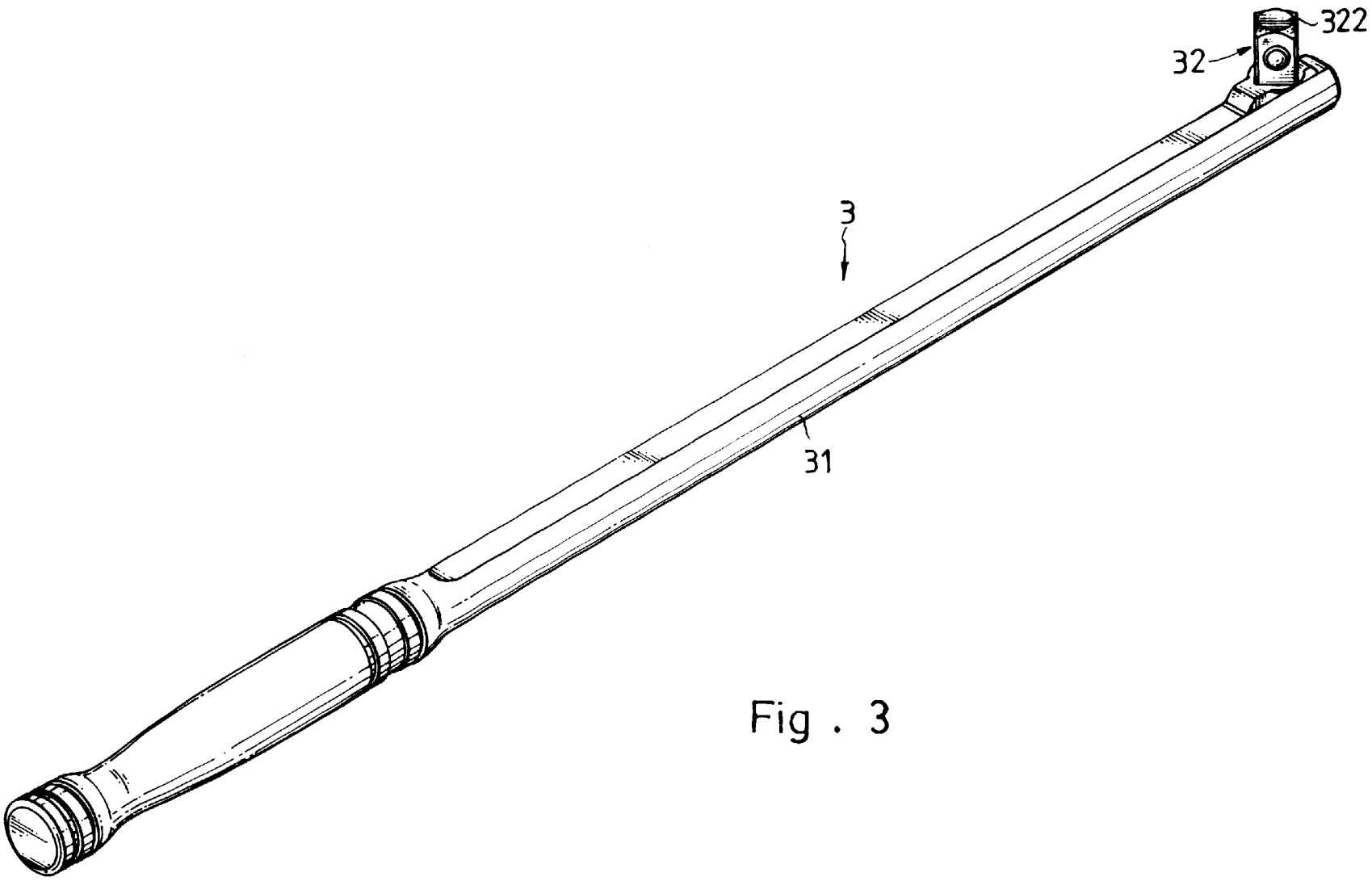
FIG. 3 is an elevational view of a F-type socket wrench according to one embodiment of the present invention.
Figure 4:
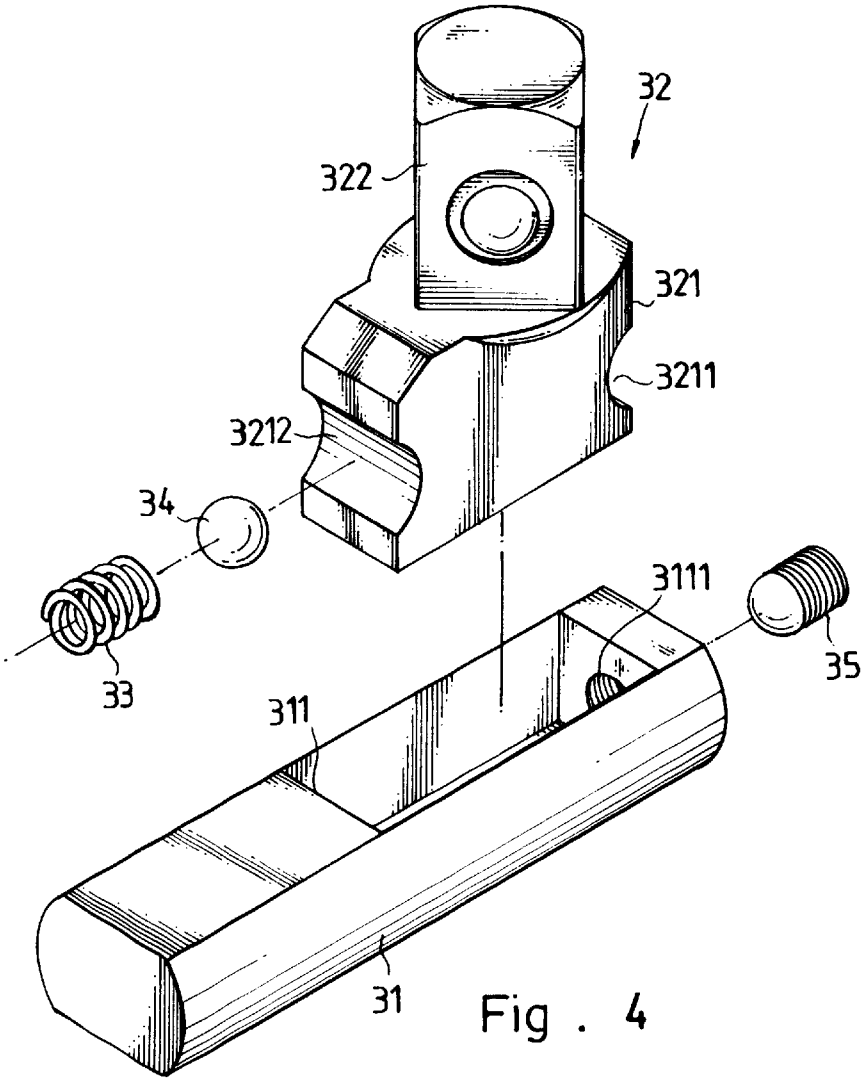
FIG. 4 is an exploded view in an enlarged scale of the F-type socket wrench shown in FIG. 3.
Figure 6:
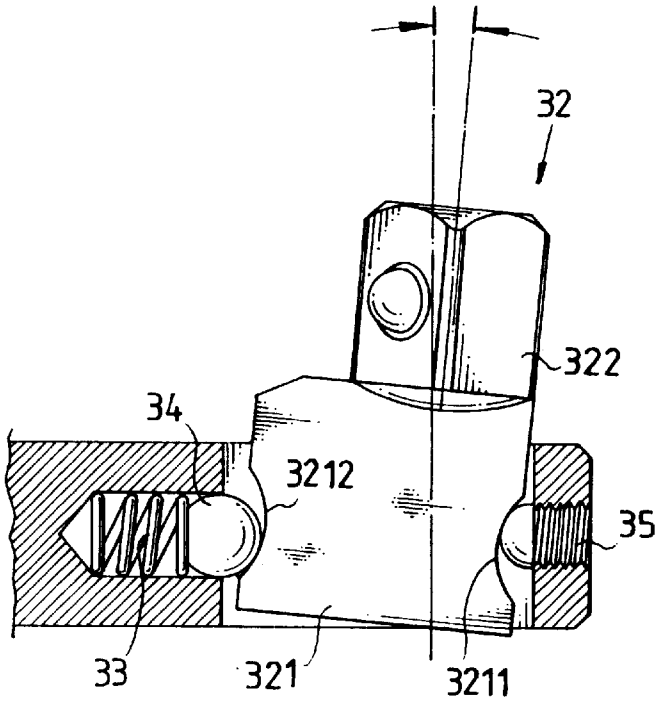
FIG. 6 is another sectional view of the present invention, showing the coupling block tilted in another direction.
Figure 5:
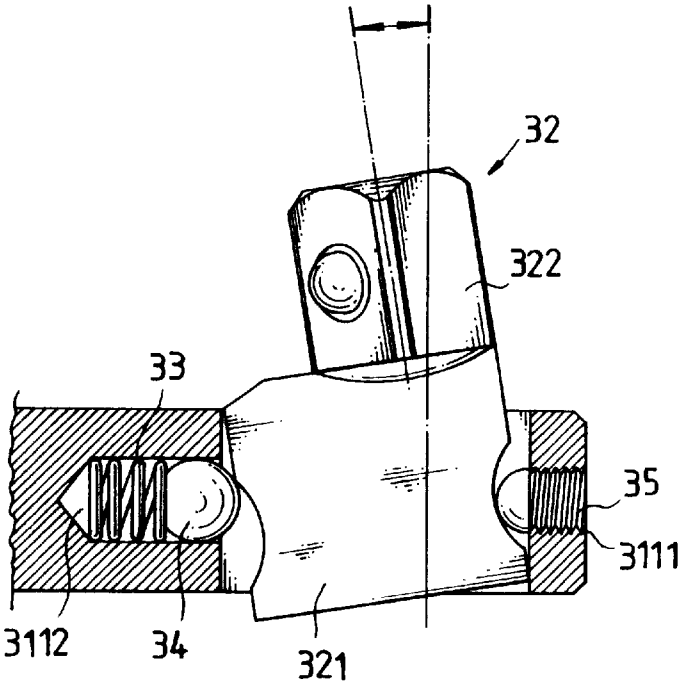
FIG. 5 is a sectional view of the present invention, showing the coupling block tilted in one direction.

Referring to FIGS. 3 to 6, a F-type socket wrench 3 in accordance with the present invention is comprised of a handle 31, a coupling block 32, a spring 33, a steel ball 34, and a tightening up screw 35. The handle 31 comprises an opening 311 at one side near its front end, an axial screw hole 3111 at its front end in communication with the opening 311, and an axial blind hole 3112 extended from one side of the opening 311 and disposed in longitudinal alignment with the screw hole 3111. The coupling block 32 comprises a base 321 mounted in the opening 311 of the handle 31, a transverse front groove 3211 at a front side of the base 321, a transverse back groove 3212 at a back side of the base 321, and a square coupling rod 322 perpendicularly raised from an upper surface of the base 321. The spring 33 is mounted in the axial blind hole 3112 of the handle 31 to impart a forward pressure to the base 321 of the coupling block 32. The steel ball 34 is supported on the spring 33 and stopped against the transverse back groove 3212 of the base 321 of the coupling block 32. The tightening up screw 35 is threaded into the axial screw hole 3111 of the handle 31 with its rounded front end stopped against the transverse front groove 3211 of the base 321 of the coupling block 32. When assembled, the coupling block 32 can be turned in the opening 311 of the handle 31 within a limited angle (see FIGS. 5 and 6). Further, one diagonal line between two angles of the square coupling rod 322 is disposed in parallel to the longitudinal center line of the handle 31.

Figure 8:
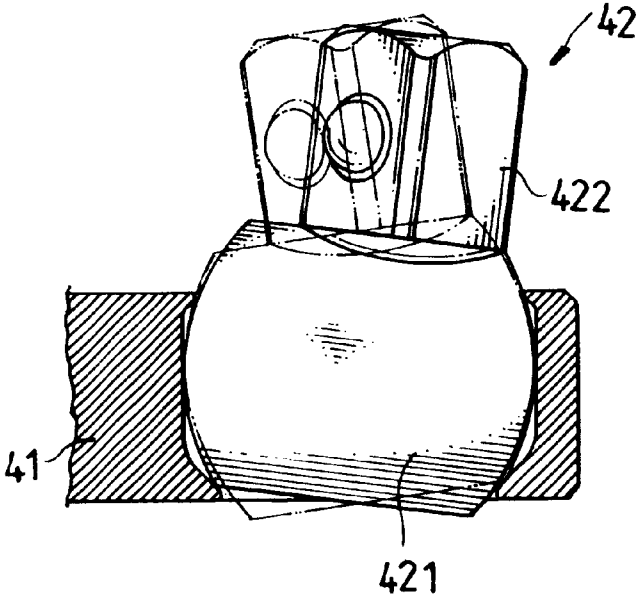
FIG. 8 is similar to FIG. 7 but showing the coupling block tilted.
Figure 7:
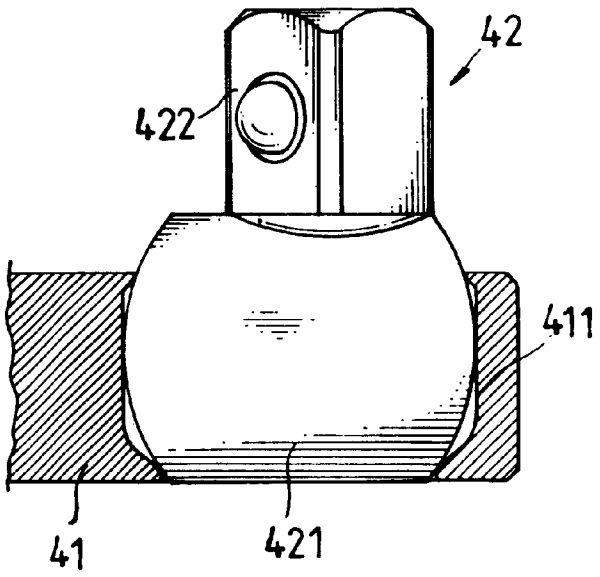
FIG. 7 is a sectional view of an alternate form of the present invention.

FIGS. 7 and 8 show an alternate form of the present invention. According to this alternate form, the opening 411 of the handle 41 forms a ball socket, the base 421 of the coupling block 42 has a spherical shape received in the ball socket of the opening 411, and one diagonal line between two angles of the square coupling rod 422 is disposed in parallel to the longitudinal center line of the handle 41.

What is claimed is:

1. An F-type socket wrench comprising:

a handle having an opening at one side near a front end, an axial screw hole at said front end in communication with said opening, and an axial blind hole extended from one side of said opening and disposed in longitudinal alignment with said axial screw hole;

a coupling block having a base mounted in said opening of said handle, a transverse front groove at a front side of said base, a transverse back groove at a back side of said base, and a square coupling rod perpendicularly raised from an upper surface of said base for turning a wrench socket;

a spring mounted in said axial blind hole of said handle to impart a forward pressure to said base of said coupling block;

a steel ball supported on said spring and abutting said transverse back groove of said base of said coupling block; and a tightening screw threaded into said axial screw hole of said handle and having a rounded front end abutting said transverse front groove of said base of said coupling block.

* * * * *